United States Patent [19]

Ishikawa et al.

[11] Patent Number: 4,562,822

[45] Date of Patent: Jan. 7, 1986

[54] IGNITION SYSTEM FOR AN INTERNAL COMBUSTION ENGINE

[75] Inventors: Yasuki Ishikawa; Hiroshi Endo, both of Yokosuka; Masazumi Sone, Tokyo; Akio Kawai, Yokohama, all of Japan

[73] Assignee: Nissan Motor Company, Limited, Yokohama, Japan

[21] Appl. No.: 451,288

[22] Filed: Dec. 20, 1982

[30] Foreign Application Priority Data

Jan. 29, 1982 [JP] Japan ..... 57-11792

[51] Int. Cl.[4] ..... F02P 3/04; F02P 3/08

[52] U.S. Cl. ..... 123/620; 123/640

[58] Field of Search ..... 123/598, 606, 620, 628, 123/640, 654, 655, 656

[56] References Cited

U.S. PATENT DOCUMENTS

| | | | |
|---|---|---|---|
| 4,004,561 | 1/1977 | Thieme | 123/598 |
| 4,033,316 | 7/1977 | Birchenough | 123/598 |
| 4,122,816 | 10/1978 | Fitzgerald et al. | 123/620 |
| 4,136,301 | 1/1979 | Shimojo et al. | 123/620 X |
| 4,223,656 | 9/1980 | Hamley | 123/598 |
| 4,301,782 | 11/1981 | Wainwright | 123/620 |
| 4,317,068 | 2/1982 | Ward et al. | 123/654 |
| 4,345,575 | 8/1982 | Jorgensen | 123/620 X |
| 4,369,756 | 1/1983 | Ezoe | 123/620 |
| 4,369,757 | 1/1983 | Anzal | 123/620 |
| 4,407,259 | 10/1983 | Abo | 123/620 |
| 4,409,952 | 10/1983 | Canup | 123/620 |

FOREIGN PATENT DOCUMENTS

| | | |
|---|---|---|
| 2304207 | 2/1974 | Fed. Rep. of Germany . |
| 3015611 | 10/1980 | Fed. Rep. of Germany . |
| 3015609 | 10/1980 | Fed. Rep. of Germany . |

*Primary Examiner*—Tony M. Argenbright

*Attorney, Agent, or Firm*—Schwartz, Jeffery, Schwaab, Mack, Blumenthal & Evans

[57] ABSTRACT

An ignition system for an internal combustion engine comprises a voltage boosting means which generates a high DC voltage by boosting a low DC voltage, a capacitor which charges the high DC voltage from the voltage boosting means, and ignition coil means having a secondary winding to which the high DC voltage is applied from the boosting means, wherein a high capacitive energy charged within the capacitor is supplied into one of spark plugs located within a corresponding engine cylinder in which a spark discharge has started and subsequently the output energy from the boosting means is supplied into that spark plug via the secondary winding of the ignition coil. Consequently, the ignition energy can sufficiently be supplied immediately after an ignition start to which a combustion characteristic is closely related and the complete combustion of air-fuel mixture can be achieved over the whole range of engine revolutional speed.

4 Claims, 4 Drawing Figures

IGNITION SYSTEM FOR AN INTERNAL COMBUSTION ENGINE

BACKGROUND OF THE INVENTION (1) Field of the Invention

The present invention relates to an ignition system for an internal combustion engine, wherein a high DC voltage is applied to a secondary winding of an ignition coil so as to extend the spark discharge for a longer period of time. A high DC voltage is also applied to a capacitor and the capacitive energy charged within the capacitor is sent into one of the spark plugs for sustaining arc discharge at the spark plug. Further, inductive energy in the coil is also sent into the spark plug, in which the spark discharge occurs, upon receipt of a high voltage surge generated at the secondary winding of the coil when a primary current of the ignition coil is interrupted in synchronization with engine rotation.

(2) Description of the Prior Art

A conventional ignition system for an internal combustion engine comprises: (a) a plurality of spark plugs each located within a corresponding engine cylinder; (b) a low DC voltage supply such as a storage battery; (c) an ignition coil; (d) a resistor; (e) a distributor having a rotor electrode and a plurality of fixed electrodes extending radially from the rotor electrode as a center and equally spaced apart from each other, each fixed electrode being connected to the corresponding spark plug via a noise supression cable according to an ignition order; (f) a contact breaker which opens so as to interrupt a primary current flowing through a primary winding of the ignition coil in synchronization with engine rotation; and (g) an arc extinguishing capacitor connected across the contact breaker. The ignition coil has primary and secondary windings, wherein one end of the primary winding is connected to a positive pole of the DC voltage supply via the resistor, one end of the secondary winding is connected to the rotor electrode of the distributor, and the other ends of both primary and secondary windings are connected to each other and grounded via the contact breaker. When contact points of the contact breaker are separated, the primary current flow from the low DC voltage supply through the primary winding of the ignition coil and resistor to ground is interrupted so that a high voltage surge with a peak value of minus 20 kilovolts to minus 30 kilovolts is generated at the secondary winding of the coil. The high voltage surge is sequentially applied to one of the spark plugs during the ignition stroke of the engine cycle via the distributor. At this time, a spark discharge occurs at a discharge gap of the spark plug when the high voltage surge exceeds a breakdown voltage of the gap. Subsequently, inductive energy stored in the ignition coil extends the discharge phenomenon so as to ignite the compressed air-fuel mixture supplied into the corresponding engine cylinder.

However, there are drawbacks in such a conventional ignition system. Since the inductive energy in the ignition coil is sent into the individual spark plugs, the capacity of the ignition coil (inductance) needs to be increased to increase the ignition energy for lean air-fuel mixture. However, since there is a limitation for increasing the capacity of the ignition coil, it is hardly possible to increase the ignition energy immediately after the ignition is started, e.g., during engine cranking. The ignition start has a close connection with fuel economy. On the other hand, if the discharge duration is extended in order to improve combustion stability at the time of engine idling and low engine speed, the capacity of ignition coil needs to be enlarged and consequently the efficiency of supplying ignition energy is decreased.

SUMMARY OF THE INVENTION

With the above-described drawbacks in mind, it is an object of the present invention to provide an improved ignition system for an internal combustion engine, wherein a voltage boosting means is provided for applying a high DC voltage to the secondary winding of the ignition coil so as to sustain the spark discharge and another voltage boosting means and capacitor are provided for discharging a high ignition energy into one of the spark plugs immediately after the spark discharge occurs so as to extend the discharge duration, whereby combustion of the air-fuel mixture can become stable over the whole range of engine rotation without misfire and fuel consumption can remarkably be improved.

BRIEF DESCRIPTION OF THE DRAWINGS

A more complete understanding of the present invention may be obtained from the following detailed description taken in conjunction with the drawings in which like reference numerals designate corresponding elements and in which.

DETAILED DESCRIPTION OF THE PREFERRED EMBODIMENTS

Reference will be made to the drawings in order to facilitate understanding of the present invention.

Figure 1:
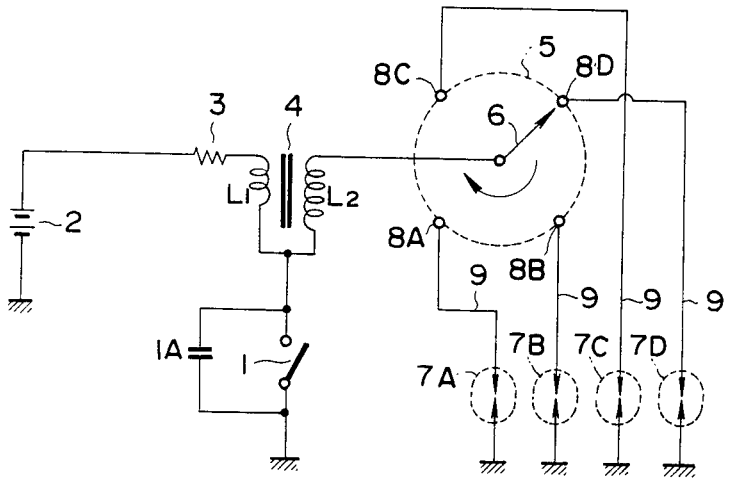
FIG.1 PRIOR ART
FIG. 1 is a block diagram of a conventional ignition system applied to a four-cylinder internal combustion engine.

First, FIG. 1 shows a conventional ignition system applied to a four-cylinder internal combustion engine.

In FIG. 1, numeral 1 denotes a contact breaker. The contact points of the contact breaker 1 close and open once for each cylinder with every breaker-cam rotation. The breaker cam (not shown) rotates at half crankshaft speed. Numeral 2 denotes a low DC voltage supply such as a storage battery having a 12 volt rating. Numeral 3 denotes a resistor for protecting the contact points of the contact breaker 1 from excessive current. Numeral 4 denotes an ignition coil having a primary winding $L_1$ and secondary winding $L_2$. One end of the primary winding $L_1$ is connected to a positive pole of the low DC voltage supply 2 via the resistor 3 and one end of the secondary winding $L_2$ is connected to the other end of the primary winding. The common end of the ignition coil 4 is grounded via the contact breaker 1. Numeral 5 denotes a distributor, having a rotor electrode 6 connected to the other end of the secondary winding $L_2$ of the ignition coil 4. Electrode 6 rotates with the breaker cam. A plurality of fixed electrodes 8A through 8D are equally spaced apart from each other along a circumferential end of the distributor 5. The rotor electrode 6 sequentially connects electrically the other end of the secondary winding $L_2$ to the spark plugs 7A through 7D. The number of fixed electrodes 8A through 8D corresponds to that of the engine cylinders. It should be noted that a central electrode of each spark plug 7A through 7D is connected to the corresponding fixed electrode via a high-tension noise suppression cable 9 and a side electrode of each spark plug 7A through 7D is grounded. It should also be noted that an arc extinguishing capacitor 1A is connected in parallel with the contact breaker 1A for extinguishing an arc generated between the contact points of the circuit breaker.

Whenever the contact points of the contact breaker 1 are open, a current flow through the primary winding $L_1$ of the ignition coil 4 is interrupted so that the secondary winding $L_2$ of the ignition coil 4 generates a high voltage surge of minus 20 kilovolts to minus 30 kilovolts with respect to ground. The high voltage surge is distributed to the individual spark plugs 7A through 7D sequencially according to an ignition order via the high-tension cable 9. At this time, a spark discharge occurs at the corresponding gap of the spark plug which is in the ignition stroke so that a breakdown of insulation occurs thereat if the voltage of the high surge reaches the breakdown voltage. Subsequently, inductive energy within the secondary winding $L_2$ of the ignition coil 4 is sent into the spark plug in which the spark discharge occurs so as to extend the spark discharge. Consequently, the compressed air-fuel mixture supplied into the corresponding engine cylinder is burned.

Figure 2:
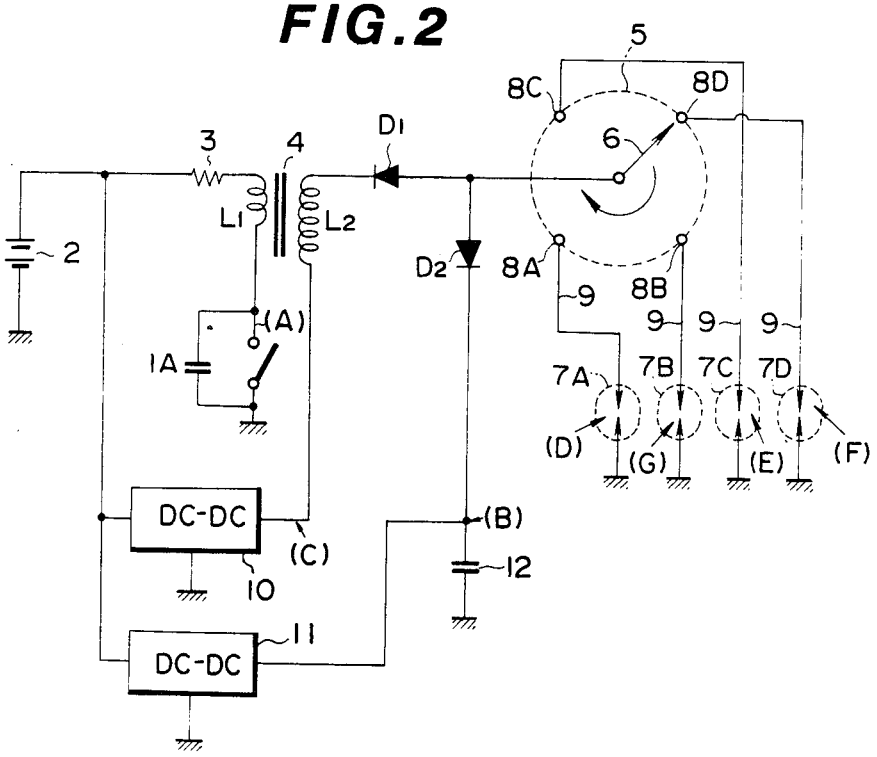
FIG. 2 is a block diagram of a first preferred embodiment of the ignition system according to the present invention applicable to a four-cylinder engine.

FIG. 2 shows a preferred embodiment of the ignition system according to the present invention.

As shown in FIG. 2, there is no such common end of the ignition coil 4 as shown in FIG. 1. The contact breaker 1 is connected between the winding of the primary end $L_1$ of the ignition coil 4 and ground. Numeral 10 denotes a first voltage booster such as a DC-DC converter. Numeral 11 denotes a second voltage booster such as a DC-DC converter. Numeral 12 denotes a capacitor of relatively high capacitance, e.g., 0.2 microfarads, connected between the second voltage booster 11 and ground. It should be noted that a first diode $D_1$ is connected between the other end of secondary winding $L_2$ of the ignition coil 4 and rotor electrode 6 of the distributor 5 and a second diode $D_2$ is connected between the rotor electrode 6 of the distributor 5 and the output terminal of the second voltage booster 11. Diodes $D_1$ and $D_2$ are provided for applying the individual output voltage to each spark plug 7A through 7D. The DC-DC converter used for voltage boosters 10 and 11 inverts the low DC voltage of 12 volts from the low DC voltage supply 2 into a high AC voltage and rectifies the high AC voltage into the corresponding high DC voltage.

Figure 3:
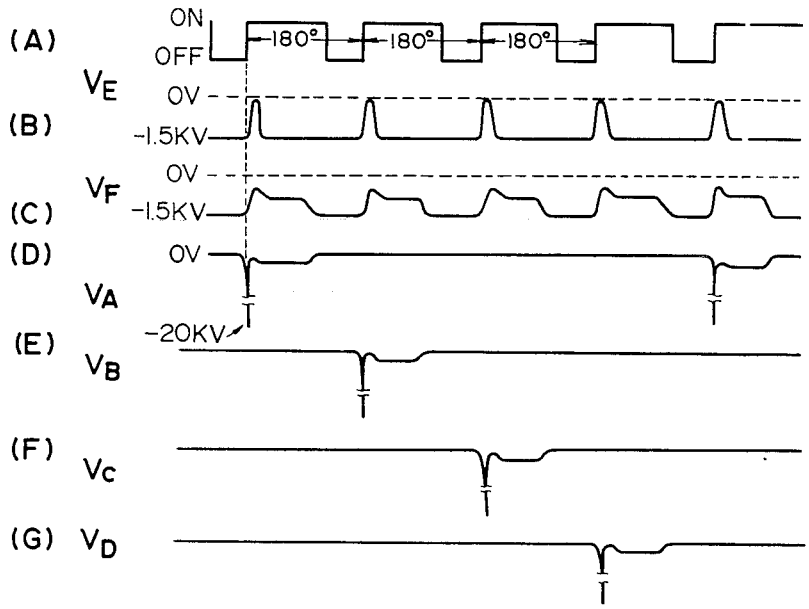
FIG. 3*a-g* is a signal timing chart at each point in the ignition system shown in FIG. 2.

FIG. 3 shows a signal timing chart of each location in the ignition system shown in FIG. 2.

The low DC voltage of 12 volts from the low DC voltage supply 2 is boosted by means of the first voltage booster 10 up to a negatively high DC voltage of minus 1500 volts. The high DC voltage is supplied into the secondary winding $L_2$ of the ignition coil 4. Simultaneously, the low DC voltage of 12 volts from the low DC voltage supply 2 is similarly boosted by means of the second voltage booster 11 into the negatively high DC voltage of minus 1500 volts. The high DC voltage outputted from the second voltage booster 11 charges the capacitor 12. At this time, the capacitor 12 charges to energy of approximately 0.2 Joules. The low DC voltage of 12 volts is also applied to the primary winding $L_1$ of the ignition coil 4 via the resistor 3. On the other hand, the contact breaker 1 interrupts the primary current whenever the engine crankshaft rotates through 180° (half rotation) as shown by (A) of FIG. 3. Therefore, a high voltage surge of, e.g., minus 20 kilovolts is generated at the secondary winding $L_2$ of the ignition coil 4 as shown by (D) through (G) of FIG. 3. The high voltage surge generated thereat is introduced into one of the fixed electrodes 8A through 8D of the distributor 5 opposing the rotor electrode 6 thereof via the diode $D_1$ and finally into the corresponding spark plug 7A through 7D. Therefore, the discharge gap of the spark plug 7A through 7D starts the spark discharge. Once the spark discharge is started, the discharge voltage $V_A$ through $V_D$ across the gap of the corresponding spark plug 7A through 7D is reduced to about minus 1 kilovolt so that the ignition energy $V_E$ charged within the capacitor 12 having a potential of minus 1.5 kilovolts (refer to (B) of FIG. 3) is fed into one of the spark plugs 7A through 7D currently in the ignition stroke of engine cycle. Therefore, an arc discharge occurs immediately after the spark discharge in the gap of the corresponding spark plug 7A through 7D due to the feed of the energy charged within the capacitor 12.

Upon the completion of the feed of the energy from the capacitor 12 into the spark plug 7A through 7D, the discharge voltage $V_A$ through $V_D$ is again increased negatively and thereafter the inductive energy in the ignition coil 4 is fed into the spark plug 7A through 7D. At this time, the output voltage $V_F$ of the first voltage booster 10 (refer to (C) of FIG. 3) is also applied to the gap of the spark plug 7A through 7D via the secondary winding $L_2$ of the ignition coil 4. Since the first voltage booster 10 is continuously operated, the spark discharge continues until the rotor electrode 6 of the distributor 5 is electrically connected with one of the fixed electrodes corresponding to the spark plug 7A through 7D.

In this way, a high capacitive energy of approximately 0.2 Joules charged within the capacitor 12 is abruptly fed into each of the spark plugs 7A through 7D as well as the inductive energy in the ignition coil 4. This occurs during a short period of time upon the start of engine ignition, which determines combustion performance. Thus, the combustion characteristic can be improved over the whole range of engine rotation.

In addition, since the output energy of the first voltage booster 10 can be fed into each spark plug 7A through 7D over a long period of time via the secondary winding $L_2$ of the ignition coil 4 immediately after the feed of capacitive energy thereinto, a stable combustion of air-fuel mixture can securely be achieved when there is a tendency for unstable ignition of the air-fuel mixture, e.g., at the time of low-load engine operation or at the time of ignition of air-fuel mixture with a lean air-fuel mixture ratio. Particularly, it is effective at the time of engine idling since the spark discharge continues over a sufficiently long time, i.e., the spark discharge does not extinguish intermediately before a perfect combustion of air-fuel mixture supplied into the engine is completed. Consequently, fuel economy can remarkably be improved.

It should be noted that the output voltage of minus 1500 volts is always applied from the second voltage booster 11 across the capacitor 12 except at each ignition timing, the output voltage of minus 1500 volts is also always applied from the first voltage booster 10 to the secondary winding $L_2$ of the ignition coil 4, and these output voltages are sequentially distributed into one of the spark plugs 7A through 7D via the distributor 5. These high voltages as described hereinabove are not applied to another spark plug except that in the ignition stroke.

Figure 4:
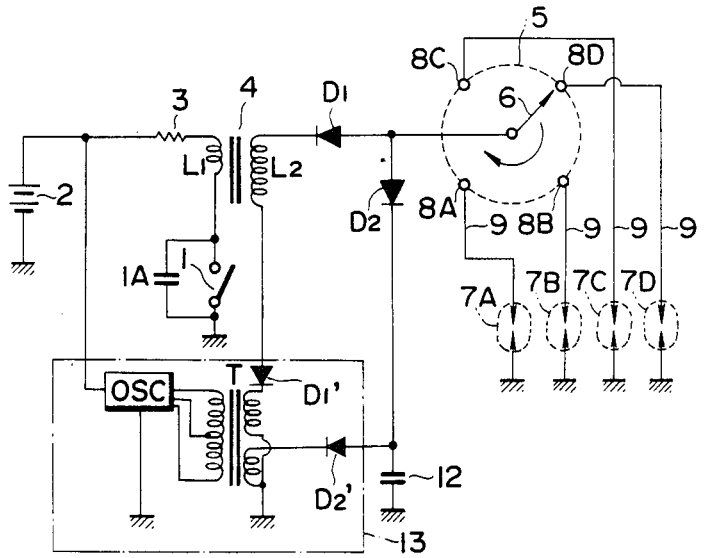
FIG. 4 is a block diagram of a second preferred embodiment according to the present invention applicable to a four-cylinder engine.

FIG. 4 shows a second preferred embodiment according to the present invention.

In FIG. 4, numeral 13 denotes a single voltage booster comprising a transformer T having a primary winding and a secondary winding, an oscillator OSC connected to the primary winding thereof for generating an alternating current in the primary winding with an intermediate top thereof as a center, an auxiliary diode $D_1'$ connected between the end of the secondary winding $L_2$ of the ignition coil 4 for rectifying the secondary AC voltage and another auxiliary diode $D_2'$ connected between the end of the capacitor 12 and another end of the secondary winding of the transformer T for rectifying the associated secondary AC voltage as shown in FIG. 4. The single voltage booster 13 outputs two boosting voltages of minus 1500 volts at the respective output terminals thereof. The other construction is the same as in the first preferred embodiment.

As described hereinbefore, the ignition system according to the present invention comprises a voltage boosting means which generates a high DC voltage by boosting a low DC voltage, a capacitor which charges to the high DC voltage from the boosting means, and an ignition coil having a secondary winding to which the high DC voltage is applied from the boosting means, wherein a high capacitive energy charged within the capacitor is supplied into one of spark plugs in which a spark discharge has started due to the interruption of a primary current in the ignition coil and subsequently the output energy from the boosting means is supplied into that spark plug via the secondary winding of the ignition coil so as to sustain the spark discharge. Consequently, the ignition energy can sufficiently be supplied into each spark plug immediately after an ignition start of the engine to which a combustion characteristic is closely related and the perfect combustion of air-fuel mixture can be achieved over the whole range of engine rotations. Furthermore, since the discharge duration can be extended, a combustion of air-fuel mixture at the time of engine idling, etc., can become stable and complete. Consequently, fuel consumption can remarkably be reduced.

It will be clearly understood by those skilled in the art that modifications may be made in the preferred embodiments described hereinbefore without departing the spirit and scope of the present invention, which is to be defined by the appended claims.

What is claimed is:

1. An ignition system for an internal combustion engine, comprising:

(a) a plurality of spark plugs each located within a corresponding engine cylinder;

(b) a low DC voltage supply;

(c) an ignition coil including a primary winding connected to said low DC voltage supply and a separately wound secondary winding, and means which operatively interrupts a current flow through said primary winding from said low DC voltage supply so as to generate a high voltage surge at said secondary winding whenever the engine rotates through a predetermined angle;

(d) a distributor which sequentially connects one end of the secondary winding of said ignition coil to said individual spark plugs according to an ignition order;

(e) two DC-DC converters which boost a low DC voltage from said low DC voltage supply to provide first and second highly boosted DC voltages, said first highly boosted DC voltage being supplied by one of said DC-DC converters to the secondary winding of said ignition coil so as to continue the supply of energy through the secondary winding of said ignition coil into one of said spark plugs via said distributor; and (f) a capacitor for charging to said second highly boosted DC voltage produced by the other of the DC-DC converters, said distributor being operative to rapidly discharge said second voltage on said capacitor through one of said spark plugs so as to sustain an arc discharge immediately after the spark discharge initiated by the application of the high voltage surge generated at said secondary winding through said one of said spark plugs, said one of said DC-DC converters being connected between said low DC voltage supply and the other end of said secondary winding via a first rectifier for producing said first highly boosted DC voltage and the other DC-DC converter being connected between said low DC voltage supply on one side, and said capacitor and said distributor on another side for producing said second highly boosted DC voltage, said other DC-DC converter being connected to said distributor via a second rectifier.

2. The ignition system of claim 1, wherein the first boosted voltage of said one DC-DC converter is negatively higher than a voltage across the gap of each spark plug which occurs after the spark discharge due to the application of the high voltage surge across the gap thereof by means of said ignition coil and occurs subsequent to the arc discharge due to the supply of said second highly boosted DC voltage across said capacitor.

3. The ignition system of claim 2, wherein the first and second highly boosted voltages are each minus 1500 volts with respect to ground.

4. An ignition system for a multi-cylinder internal combustion engine, comprising:

(a) an ignition coil having a primary winding and secondary winding, a current fed through said primary winding being interrupted whenever the engine rotates through a predetermined angle so that a high voltage surge is produced across said secondary winding;

(b) a plurality of spark gaps of spark plugs each spark gap being located within a corresponding engine cylinder;

(c) a distributor which rotates in synchronization with the engine so that one terminal of said secondary winding of said ignition coil is connected sequentially to said spark gaps according to an ignition order; and (d) a DC-DC converter including a capacitor which produces a first DC voltage which is continuously applied to said capacitor so that immediately after said high voltage surge is applied across one of said spark gaps via said distributor, the first DC voltage charged by said capacitor is sent into said one of said spark gaps for sustaining an arc discharge following a spark discharge due to the application of said high voltage surge and produces a second DC voltage which is continuously applied to said secondary winding of said ignition coil so that immediately after the end of the arc discharge due to the supply of the first DC voltage from said capacitor, inductive energy induced across the secondary winding of said ignition coil during the generation of the high voltage surge is sent into said spark gap.

* * * * *